US007494600B2

(12) United States Patent
Kjellén et al.

(10) Patent No.: US 7,494,600 B2
(45) Date of Patent: Feb. 24, 2009

(54) COMPOSITION FOR PRODUCING SOFT MAGNETIC COMPOSITES BY POWDER METALLURGY

(75) Inventors: Lisa Kjellén, Helsingborg (SE); Åsa Ahlin, Höganäs (SE); Lars Hultman, Viken (SE); Ola Andersson, Nyhamnsläge (SE)

(73) Assignee: Höganäs AB, Höganäs (SE)

( * ) Notice: Subject to any disclaimer, the term of this patent is extended or adjusted under 35 U.S.C. 154(b) by 452 days.

(21) Appl. No.: 11/015,254

(22) Filed: Dec. 20, 2004

(65) Prior Publication Data

US 2005/0139038 A1 Jun. 30, 2005

Related U.S. Application Data

(60) Provisional application No. 60/543,277, filed on Feb. 11, 2004.

(30) Foreign Application Priority Data

Dec. 29, 2003 (SE) ..... 0303580

(51) Int. Cl.
*H01F 1/20* (2006.01)
*H01F 1/22* (2006.01)

(52) U.S. Cl. ..... 252/62.55; 252/62.53; 252/62.54; 148/104

(58) Field of Classification Search ..... None
See application file for complete search history.

(56) References Cited

U.S. PATENT DOCUMENTS

| | | | | |
|---|---|---|---|---|
| 5,338,508 | A | 8/1994 | Nitta et al. | |
| 5,627,258 | A | 5/1997 | Takayama et al. | |
| 6,348,265 | B1 | 2/2002 | Jansson et al. | |
| 6,537,389 | B1 | 3/2003 | Aichele et al. | |
| 6,926,963 | B2 | 8/2005 | Ohmori et al. | |
| 6,979,409 | B2 | 12/2005 | Chen et al. | |
| 2002/0084440 | A1 | 7/2002 | Ohmori et al. | |
| 2003/0180455 | A1 * | 9/2003 | Maetani et al. | 427/213 |
| 2004/0005479 | A1 | 1/2004 | Kitamura et al. | |
| 2004/0126609 | A1 * | 7/2004 | Ueta et al. | 428/570 |
| 2006/0112783 | A1 * | 6/2006 | Ahlin et al. | 75/252 |
| 2006/0165985 | A1 * | 7/2006 | Matsukawa et al. | 428/384 |

FOREIGN PATENT DOCUMENTS

| | | |
|---|---|---|
| EP | 0 589 088 | 3/1994 |
| EP | 1 205 949 | 5/2002 |
| WO | WO 01/22448 | 3/2001 |

* cited by examiner

*Primary Examiner*—John P. Sheehan
(74) *Attorney, Agent, or Firm*—Buchanan Ingersoll & Rooney PC

(57) ABSTRACT

The invention concerns powder compositions consisting of electrically insulated particles of a soft magnetic material of an iron or iron-based powder and 0.1-2% by weight of a lubricant selected from the group consisting of fatty acid amides having 14-22 C atoms. Optionally a thermoplastic binder such as polyphenylene sulphide may be included in the composition. The invention also concerns a method for the preparation of soft magnetic composite components.

10 Claims, 1 Drawing Sheet

Core loss/cycle (loop) at 1 T as a function of frequency

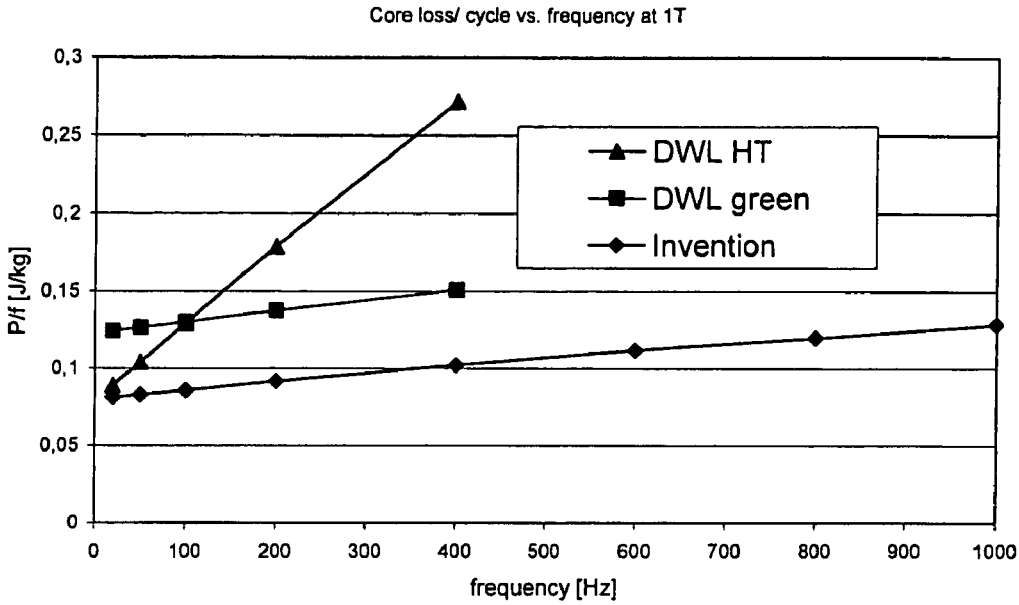
Figure 1: Core loss/cycle (loop) at 1 T as a function of frequency

COMPOSITION FOR PRODUCING SOFT MAGNETIC COMPOSITES BY POWDER METALLURGY

The benefit is claimed under 35 U.S.C. § 119(a)-(d) of Swedish Application No. 0303580-5, filed Dec. 29, 2003, and under 35 U.S.C. §119(e) of U.S. Provisional Application No. 60/543,277, filed Feb. 11, 2004.

FIELD OF THE INVENTION

The present invention relates to iron-based powder compositions. More specifically, the invention concerns powder compositions for producing soft magnetic composite components by the powder metallurgical production route. The compositions facilitates the manufacture of the soft magnetic composite component having high density as well as valuable magnetic and mechanical properties.

BACKGROUND OF THE INVENTION

Soft magnetic materials are used for applications, such as core materials in inductors, stators and rotors for electrical machines actuators, sensors and transformer cores. Traditionally, soft magnetic cores, such as rotors and stators in electric machines, are made of stacked steel laminates. Soft Magnetic Composite, SMC, materials are based on soft magnetic particles, usually iron-based, with an electrically insulating coating on each particle. By compacting the insulated particles optionally together with lubricants and/or binders using the traditionally powder metallurgy process, the SMC parts are obtained. By using this powder metallurgical technique it is possible to produce materials giving a higher degree of freedom in the design of the SMC component than by using the steel laminates as the SMC material can carry a three dimensional magnetic flux and as three dimensional shapes can be obtained by the compaction process.

Two key characteristics of an iron core component are its magnetic permeability and core loss characteristics. The magnetic permeability of a material is an indication of its ability to become magnetised or its ability to carry a magnetic flux. Permeability is defined as the ratio of the induced magnetic flux to the magnetising force or field intensity. When a magnetic material is exposed to a alternating magnetic field, energy losses, core losses, occur due to both hysteresis losses and eddy current losses. The hysteresis loss is brought about by the necessary expenditure of energy to overcome the retained magnetic forces within the iron core component and is proportional to the frequency of the alternating field. The eddy current loss is brought about by the production of electric currents in the iron core component due to the changing flux caused by alternating current (AC) conditions and is proportional to the square of the frequency of the alternating field. A high electrical resistivity is then desirable in order to minimise the eddy currents and is of especial importance at higher frequencies. In order to decrease the hysteresis losses and to increase the magnetic permeablity of a core component for AC applications it is generally desired to heat-treat the compacted part.

Research in the powder-metallurgical manufacture of magnetic core components using coated iron-based powders has been directed to the development of iron powder compositions that enhance certain physical and magnetic properties without detrimentally affecting other properties of the final component. Desired component properties include e.g. a high permeability through an extended frequency range, low core losses, high saturation induction, (high density) and high strength. Normally an increased density of the component enhances all of these properties.

The desired powder properties include suitability for compression moulding techniques, which i.a. means that the powder can be easily moulded into a high density, high strength component which can be easily ejected from the moulding equipment and that the components have smooth surface finish.

The present invention concerns a new powder composition having the desired powder properties as well as the use of the powder composition for the preparation of soft magnetic composite components. The new composition can be compacted (and heat treated) to components having the desired properties.

The present invention also concerns a method for manufacturing soft magnetic iron-based components having excellent component properties as well as the soft magnetic component per se.

SUMMARY OF THE INVENTION

In brief the powder composition according to the invention is made up by electrically insulated particles of a soft magnetic material and a fatty acid amide lubricant. Optionally a thermoplastic binder is present in the composition. The method according to the present invention includes mixing, compaction and optionally heat treatment of the obtained component resulting in a soft magnetic iron-based component having excellent properties.

DETAILED DESCRIPTION OF THE INVENTION

The powder is preferably a substantially pure, water atomised iron powder or a sponge iron powder having irregularly shaped particles. In this context the term "substantially pure" means that the powder should be substantially free from inclusions and that the amounts of the impurities O, C an N should be kept at a minimum. The average particle sizes are generally below 300 μm and above 10 μm. Examples of such powders are ABC 100.30, ASC 100.29, AT 40.29, ASC 200, ASC 300, NC 100.24, SC 100.26, MH 300, MH 40.28, MH 40.24 available from Hoganas AB, Sweden.

According to one embodiment of the invention the powders used have coarser particles than what is normal in common die pressing. In practice this means that the powders are essentially without fine particles. The term "essentially without fine particles" is intended to mean that less than about 10%, preferably less than 5% the powder particles have a size below 45 μm as measured by the method described in SS-EN 24 497. The average particle diameter is typically between 106 and 425 μm. The amount of particles above 212 μm is typically above 20%. The maximum particle size may be about 2 mm.

The size of the iron-based particles normally used within the PM industry is distributed according to a gaussian distribution curve with an average particle diameter in the region of 30 to 100 μm and about 10-30% of the particles are less than 45 μm. Thus, the powders used according to the present invention may have a particle size distribution deviating from that normally used. These coarse powders may be obtained by removing the finer fractions of the powder or by manufacturing a powder having the desired particle size distribution. The invention is however not limited to the coarse powders but also powders having the particle sizes normally used for die pressing within the PM industry are included in the present invention.

The electrical insulation of the powder particles may be made of an inorganic material. Especially suitable are the type of insulation disclosed in the U.S. Pat. No. 6,348,265 (which is hereby incorporated by reference), which concerns particles of a base powder consisting of essentially pure iron having an insulating oxygen- and phosphorus-containing barrier. As regards the coating it should be especially mentioned that the properties of the composite component may be influenced by the thickness of the coating. Powders having insulated particles are available as Somaloy™ 500 and 550 from Hoganas AB, Sweden.

The lubricant used according to the invention is selected from the group consisting of fatty acid amides. Particularly suitable amides are primary amides of saturated or unsaturated fatty acid having 12-24, preferably 14-22 C atoms and most preferably 18-22 C atoms. The lubricants may be used in amounts less than 2% and preferably less than 1.5% by weight of the composition. Especially preferred amounts of the lubricant are 0.05-1%, preferably 0.05-0.8 more preferably 0.1-0.8% and most preferably 0.1-0.5% by weight. Especially preferred lubricants are stearic acid amide, oleic acid amide, behenic acid amide, eurcic acid amide, palmitic acid amide, the stearic acid amide being most preferred. In the U.S. Pat. No. 6,537,389 stearic acid amide seemingly in combination with rapeseed oil methyl ester is mentioned as a lubricant in connection with a termoplastic resin, polyphatalamide as a binder for the compaction of soft magnetic powders.

Solid lubricants generally have a density of about 1-2 g/cm$^3$ which is very low in comparison to the density of the iron-based powder, which is about 7.8 g/cm$^3$. As a consequence, inclusions of these less dense lubricants in the compositions will lower the theoretical density of the compacted component. It is therefore essential to keep the amount of lubricant at low levels in order to produce high-density components. However, low amounts of lubricants tend to give ejection problems. It has now unexpectedly been found that the type of lubricants mentioned above can be used in low amounts without ejection problems.

By replacing the internal lubricants, i.e. lubricants added to the iron-based powder mix, with lubrication of the die wall, DWL, in combination with high compaction pressures high green densities can be reached. One drawback with this known method when compacting insulated iron-based powder at high compaction pressures, is however that the insulation of the iron-based powder is easily damaged leading to high core losses at higher frequencies. Furthermore, the use of DWL will add further process complexibility, it may prolong cycle times and decrease the production robustness in an industrial environment.

According to the present invention the fatty acid amide may be used as the only additive to the insulated iron or iron-based powder, although for certain applications it is advantageous to add minor amounts of a thermoplastic resin, specifically polyphenylene sulfide (PPS). The term "minor amounts" should in this context be interpreted as less than 2, preferably less 0.8, more preferably less than 0.6 and most preferably less than 0.5% by weight of the composition. In amounts lower than 0.05 no effects of PPS have been observed. Specifically the amount of PPS could vary between 0.1 and 0.5 and preferably between 0.2 and 0.5 or 0.4% by weight. The addition of PPS is of particular interest when good frequency stability is required.

The combination of PPS and stearic acid is known from the patent application WO01/22448. The examples of this application disclose that a soft magnetic material can be produced by mixing an electrically insulated iron-based powder with PPS and stearic acid. The mixture is compacted at elevated temperature and the obtained compacted part is heat treated at 260° C. in an atmosphere of nitrogen followed by a second heat treatment at 285 to 300° C. It has now unexpectedly been found that by using the new powder composition, which includes a fatty acid amide in stead of a corresponding fatty acid several advantages can be obtained. Thus it has been found that the new powder has unexpectedly improved lubricating properties, which results in that lower ejection energy is needed to eject the compacted part from the die, that higher densities and that better transverse rupture strength can be obtained. Furthermore, the compaction step can be performed at ambient temperature. Also the heat treatment can be facilitated, as the first heat-treating step, which is required according to the WO publication, can be omitted.

Iron-based magnetic powders, which have insulated particles and which are combined with thermoplastic resins, are described in the US patent application 2002/0084440. In contrast to the particles according to the present invention these previously known particles also include a rare earth element. Furthermore, the thermoplastic resin is used in relatively large amounts, namely at least 5% by weight. Additionally, the particle size of the iron-based powder is quite small (3 μm is mentioned as an example). A lubricant selected from a wide variety of chemical compounds may also be included. These powder compositions are taught to be useful preferably for injection molding, extrusion, injection compression molding and injection pressing for the preparation of highly weather-resistant bonded permanent magnets.

In order to prepare composite components according to the present invention the powder composition is first uniaxially pressed in a die, which normally must not be lubricated, although the powder composition may also be used in lubricated dies. The compacted component is then ejected from the die and optionally subjected to a heat treatment.

The compaction may be performed at ambient or elevated temperatures and at pressures up to 1500 MPa.

According to a preferred embodiment of the invention the compaction is performed in a moderately heated tool as in this way not only the green density and the ejection behaviour but also the maximum relative permeability will be improved. When comparing properties of components compacted at an elevated temperature and at a lower compaction pressure to properties of components compacted to the same green density at ambient temperature and at a higher compaction pressure the component compacted at an elevated temperature will have a higher permeability. For larger components it may be necessary to elevate the temperature of the powder as well in order to achieve the improvements according to the invention.

The heat treatment can be performed in one or several steps. A recommended one step heat treatment is performed for a period of 30 minutes to 4 hours in an oxygen-containing atmosphere (air) at a temperature between 250 and 550° C.

Another alternative is to perform the heat treatment at 250-350° C. for a period of 30 minutes to 3 hours in a air or inert gas followed by a heat treatment for 15 minutes to 2 hours in an oxygen containing (air) atmosphere at a temperature between 350 and 550° C.

A somewhat different heat treatment is recommended when PPS is included in the composition. Thus in this case the heat treatment may be performed at 250-350° C. for 30 minutes to 4 hours in an oxygen-containing atmosphere (air). Another alternative is to perform the heat treatment at 250-350° C. for 30 minutes to 3 hours in air or inert gas followed by 300-500° C. for 15 minutes to 2 hours in an oxygen containing atmosphere (air).

The possibility of performing the heat treatment by using different atmospheres, periods of time and temperatures in order to obtain a final component having the desired properties makes the new powder composition especially attractive.

By compacting a composition comprising an iron-based insulated powder having coarse particles and a lubricant as described above at high pressures, such as above 800 MPa, followed by heat treatment of the compacted component, soft magnetic composite components having a density≧7.5 g/cm$^3$, a maximum relative permeability, μmax≧600, a coercive force, Hc≦250 A/m and a specific resistivity, ρ≧20 μΩm. Such components may be of interest for the demanding applications required in e.g. stator and rotor components in electrical machines.

The invention is further illustrated by following examples.

EXAMPLE 1

The following materials were used.

An iron-based, water atomized powder with particles having a thin inorganic coating (Somaloy™ 500, available from Höganäs AB, Sweden) was used as starting material.

PPS powder,

Stearic acid powder, lubricant A.

Stearic acid amide powder, lubricant B 3 kg of the base powder Somaloy™ 500 was mixed with PPS and stearic acid amide or stearic acid, according to table 1.

TABLE 1

Powder mixes: Lubricants and PPS, (percent by weight)

| Sample number | PPS | Lubricant |
|---|---|---|
| A 1 | 0.60% | 0.2% A |
| A 2 | 0.50% | 0.3% A |
| A 3 | 0.50% | 0.3% B |
| A 4 | 0.30% | 0.3% B |
| A 5 | 0.30% | 0.4% B |
| A 6 | 0.30% | 0.5% B |
| A 7 | 0.1% | 0.3% B |
| A 8 | 0.2% | 0.3% B |
| A 9 | — | 0.4% B |

The powder mixes were compacted into ring samples with an inner diameter of 45 mm, outer diameter 55 mm and height 5 mm at 800 MPa at ambient (room) temperature. Ring samples with a height of 10 mm were also compacted and the ejection force was measured on these samples. The ejection energy is shown in Table 2. The results show that considerably lower ejection energy is obtained by using the fatty acid amide.

TABLE 2

Ejection energy measured on ring samples with h = 10 mm.

| Sample number | PPS | Lubricant | Ejection Energy (J/cm$^2$) |
|---|---|---|---|
| A 1 | 0.60% | 0.2% A | 52 |
| A 2 | 0.50% | 0.3% A | 46 |
| A 3 | 0.50% | 0.3% B | 38 |
| A 4 | 0.30% | 0.3% B | 37 |
| A 5 | 0.30% | 0.4% B | 33 |
| A 6 | 0.30% | 0.5% B | 30 |
| A 7 | 0.10% | 0.3% B | 41 |
| A 8 | 0.20% | 0.3% B | 39 |
| A 9 | — | 0.4% B | 35 |

After compaction the parts were heat treated at 290° C. for 120 minutes in air. The obtained heat-treated rings were wound with 25 turns. The relative AC inductance permeability was measured with an LCR-meter (HP4284A) according to standard IEC 60404-6, 2$^{nd}$ Edition 2003-06.

The drop in initial permeability (frequency stability) is shown in tables 3 and 4. The drop in initial permeability is expressed as the difference between the initial permeability at 10 and 100 kHz divided by the initial permeability at 10 kHz. Table 3 shows that by increasing the amount of the fatty acid amid from 0.3 to 0.5% a better frequency stability can be obtained. Table 4 shows that by using the fatty acid amid instead of the corresponding fatty acid a better frequency stability is obtained. Furthermore table 4 discloses that without PPS a larger drop in frequency stability is obtained. However the initial permeability at 1 kHz for A9 was found to be 95 compared with 75 for A3. A high initial permeability at lower frequencies is advantageous for some applications.

TABLE 3 drop in initial permeability

| | Dμ 10-100 kHz (%) |
|---|---|
| A 4 | 7.4 |
| A 5 | 5.2 |
| A 6 | 4.2 |

TABLE 4 drop in initial permeability

| | Dμ 10-100 kHz (%) |
|---|---|
| A 2 | 6.4 |
| A 3 | 3.9 |
| A 9 | 20.9 |

The specific electrical resistivity was measured by a four point measuring method and is shown in table 5. From this table it can be concluded that by using the fatty acid amide in stead of the corresponding acid a considerably higher electrical resistivity can be obtained.

TABLE 5

Resistivity for ring samples

| Sample number | PPS | Lubricant | Specific electrical resistance, resistivity μOhom * m |
|---|---|---|---|
| A 2 | 0.50% | 0.3% A | 316 |
| A 3 | 0.50% | 0.3% B | 400 |

Samples were also tested with regard to Transverse Rupture Strength, TRS, after heat treatment at 290° C. for 120 minutes in air. The TRS was tested according to ISO 3995. TRS was also tested on parts at a temperature of 200° C. The TRS is shown in Table 6. The sample with 0.5% PPS and 0.3% stearic acid amide (A 3) shows significantly higher TRS at both room temperature (RT) and 200° C. compared with both the sample with 0.5% PPS and 0.3% stearic acid (A2) and the sample with 0.2% PPS +0.6% stearic acid (A1). The density is higher for a mix with low total organic content, which will result in higher induction and permeability (μmax).

TABLE 6

Density and TRS at room temperature and 200° C.

| Sample number | PPS | Lubricant | Density after Heat treatment g/cm$^3$ | TRS RT MPa | TRS 200° C. MPa |
|---|---|---|---|---|---|
| A1 | 0.60% | 0.2% A | 7.18 | 68 | 51 |
| A2 | 0.50% | 0.3% A | 7.18 | 46 | 30 |
| A3 | 0.50% | 0.3% B | 7.19 | 81 | 67 |
| A4 | 0.30% | 0.3% B | 7.27 | 88 | 73 |
| A5 | 0.30% | 0.4% B | 7.22 | 87 | 73 |
| A6 | 0.30% | 0.5% B | 7.17 | 51 | 68 |
| A7 | 0.10% | 0.3% B | 7.35 | 85 | 74 |
| A8 | 0.20% | 0.3% B | 7.31 | 84 | 71 |
| A9 | — | 0.4% B | 7.33 | 87 | 78 |

EXAMPLE 2

The following materials were used.

An iron-based, water atomized powder with particles having a thin phosphorus containing inorganic coating (Somaloy™ 500, available from Höganäs AB, Sweden) was used as starting material was used as starting material.

PPS powder,

Stearic acid powder, lubricant A

Stearic acid amide powder, lubricant B

Behenic acid amide powder, lubricant C

Oleic acid amide powder, lubricant D

Kenolube™.

The base powder Somaloy™ 500 was mixed with PPS and lubricants according to the following table 7.

TABLE 7

Powder mixes: Lubricants and PPS, percent by weight.

| Sample number | PPS | Lubricant |
|---|---|---|
| B 1 | 0.50% | 0.3% A |
| B 2 | 0.50% | 0.3% B |
| B 3 | 0.50% | 0.3% C |
| B 4 | 0.50% | 0.3% D |
| B 5 | 0.30% | 0.3% B |
| B 6 | — | 0.4% B |
| B 7 | — | 0.3% B |
| B 8 | 0.1% | 0.3% B |
| B 9 | 0.2% | 0.3% B |
| B 10 | — | 0.4% Kenolube ™ |

The powder mixes were compacted into test bars according to ISO 3995 at a compaction pressure of 800 MPa at ambient temperature. After compaction the parts were heat treated in a two-step heat treatment. The first step was performed at 290° C. for 105 minutes in inert nitrogen atmosphere. This step was followed by a subsequent heat treatment step at 350° C. for 60 minutes in air. Samples were tested with regard to Transverse Rupture Strength, TRS, according to ISO 3995.

Results from testing of transverse rupture strength are shown in table 8. As can be seen from table 8 samples prepared with mixtures including the fatty acid amide give sufficient TRS-values. A higher density after heat treatment is reached, which is beneficial in terms on induction and permeability. If the PPS content is reduced to 0.3% or less the TRS is increased to values above 80 MPa. The samples without PPS and with the stearic acid amide lubricant even have TRS values above 100 MPa. The use of Kenolube™, which is a conventionally used lubricant, does not result in the required transverse rupture strength.

TABLE 8

Density and TRS at room temperature

| Sample numbers | PPS | Lubricant | Density after HT g/cm$^3$ | TRS-RT MPa |
|---|---|---|---|---|
| B 1 | 0.50% | 0.3% A | 7.18 | 73 |
| B 2 | 0.50% | 0.3% B | 7.22 | 68 |
| B 3 | 0.50% | 0.3% C | 7.23 | 73 |
| B 4 | 0.50% | 0.3% D | 7.24 | 74 |
| B 5 | 0.30% | 0.3% B | 7.32 | 83 |
| B 6 | — | 0.4% B | 7.37 | 108 |
| B 7 | — | 0.3% B | 7.41 | 113 |
| B 8 | 0.1% | 0.3% B | 7.35 | 88 |
| B 9 | 0.2% | 0.3% B | 7.32 | 79 |
| B 10 | — | 0.4% Kenolube ™ | 7.42 | 32 |

EXAMPLE 3

This example shows that, in comparison with the commonly used Zinc Stearate and Ethylene bis stearamide lubricants, low ejection forces during ejection of compacted components and perfect surface finish of the ejected component are obtained, when the fatty acid amide lubricants according to the invention are used in low amount in combination with coarse powders and high compaction pressures.

Two kilos of a coarse soft magnetic iron-based powder, wherein the particles are surrounded by an inorganic insulation according to U.S. Pat. No. 6,348,265 were mixed with 0.2% by weight of lubricants according to table 9. The particle size distribution of the coarse iron-based powder is shown in table 10. Mix E and F are comparative examples containing known lubricants.

TABLE 9

| Mix | Lubricant |
|---|---|
| A | Behenamide |
| B | Erucamide |
| C | Stearamide |
| D | Oleylamide |
| E | Zinc Stearate |
| F | Ethylene bis stearamide |

TABLE 10

| Particle size (μm) | Weight % |
|---|---|
| >425 | 0.1 |
| 425-212 | 64.2 |
| 212-150 | 34.0 |
| 150-106 | 1.1 |
| 106-75 | 0.3 |
| 45-75 | 0.2 |
| <45 | 0 |

The obtained mixes were transferred to a die and compacted into cylindrical test samples (50 grams) with a diameter of 25 mm, in an uniaxially press movement at a compaction pressure of 1100 MPa. The used die material was conventional tool steel. During ejection of the compacted samples the ejection force was recorded. The total ejection energy/enveloping area needed in order to eject the samples was calculated. The following table 11 show ejection energy, green density and the surface finish.

TABLE 11

| Mix | Ejection energy ($J/cm^2$) | Green density ($g/cm^3$) | Surface finish |
|---|---|---|---|
| A | 90 | 7.64 | Perfect |
| B | 83 | 7.65 | Perfect |
| C | 93 | 7.63 | Perfect |
| D | 70 | 7.67 | Acceptable |
| E | 117 | 7.66 | Not Acceptable |
| F | 113 | 7.64 | Perfect |

EXAMPLE 4

The following example illustrates the effect of the particle size distribution of the soft magnetic iron-based powder on ejection behaviour and green density. A "coarse" powder according to example 3 was used. The particle size distribution of the "fine" powder is given in table 12. The mixes were prepared using 0.2% stearamide by weight according to the procedure in example 3. The mixture based on the "fine" powder is marked sample H and were compared with sample C.

TABLE 12

| Particle size (μm) | Weight % |
|---|---|
| >425 | 0 |
| 425-212 | 0 |
| 212-150 | 11.2 |
| 150-106 | 25.0 |
| 106-75 | 22.8 |
| 45-75 | 26.7 |
| <45 | 14.3 |

The mixes were compacted into cylindrical samples according to the procedure used in example 3. The following table 13 shows green density and the surface appearance.

TABLE 13

| Mix | Green density ($g/cm^3$) | Surface finish |
|---|---|---|
| C | 7.63 | Perfect |
| H | 7.53 | Acceptable |

As can be seen from table 13 the composition containing fine powder results in a lower green density and deteriorated surface finish.

EXAMPLE 5

This example compares a known lubricant, ethylene bis-stearamide (EBS), and an example of the lubricant stearamide. A "coarse" powder according to example 3 was used was mixed with EBS and stearamide, respectively, according to table 14. The samples were prepared according to the procedure in example 3.

TABLE 14

| Mix | EBS (weight %) | Stearamide (weight %) |
|---|---|---|
| 1 | 0.20 | — |
| 2 | 0.30 | — |
| 3 | 0.40 | — |
| 4 | 0.50 | — |
| 5 | — | 0.10 |
| 6 | — | 0.20 |
| 7 | — | 0.30 |

The powder mixes were compacted into rings with an inner diameter of 45 mm, an outer diameter of 55 mm and the height 10 mm at 1100 MPa. During ejection of the compacted samples, the total ejection energy/enveloping area needed in order to eject the samples from the die was calculated. The following table 15 shows the calculated ejection energy/area, green density and the surface appearance.

TABLE 15

Ejection energy, green density, the surface appearance

| Mix | Ejection energy [J/cm2] | Density [g/cm3] | Surface appearance |
|---|---|---|---|
| 1 | 54 | 7.65 | Not acceptable |
| 2 | 40 | 7.61 | Acceptable |
| 3 | 33 | 7.56 | Perfect |
| 4 | 28 | 7.51 | Perfect |
| 5 | 73 | 7.67 | Acceptable |
| 6 | 38 | 7.64 | Perfect |
| 7 | 37 | 7.59 | Perfect |

As can be seen from table 15 the new lubricant can be added in amount as low as 0.2% and still a perfect surface finish can be obtained whereas the for the reference lubricant, EBS, the lowest addition is 0.4% for obtaining a perfect surface finish.

EXAMPLE 6

This example compares the magnetic properties of components manufactured with a minimum amount of the lubricating components stearamide and EBS respectively, in order to achieve similar values of ejection energy. Components made from mix 2 and mix 6 according to example 5 were compared regarding magnetic properties after heat treatment.

Ring samples according to example 5 except that the height were 5 mm were compacted. The green samples were heat treated at 300° C. for 60 minutes in air followed by a second step of heat treatment at 530° C. for 30 minutes in air. The obtained heat-treated rings were wounded with 100 sense and 100 drive turns and tested in a Brockhaus hysterisisgraph. The following table 16 shows the induction level at 10 kA/m, maximum relative permeability, coercive force $H_c$ and core loss at 400 Hz, 1 T.

TABLE 16

Soft magnetic properties.

| | Sample 2 | Sample 6 |
|---|---|---|
| Max. Permeability | 480 | 750 |
| B at 10000 A/m [T] | 1.58 | 1.66 |
| Hc [A/m] | 218 | 213 |
| Core loss 400 Hz, 1 T [W/kg] | 78.4 | 42.1 |

As can bee seen in table 16 the soft magnetic properties are superior for components according to the present invention.

EXAMPLE 7

The following example shows the influence of die temperature on the ejection properties and green density of compacted samples. In this example the primary amide, stearamide, was selected as the amide lubricant according to the invention. 0.2% of stearamide was added to 2 kg of a coarse soft magnetic electrically insulated iron-based powder according to the procedure of example 3.

The powder mixes were compacted into rings having an inner diameter of 45 mm, an outer diameter of 55 mm and a height of 10 mm, at a compaction pressure of 1100 MPa. During ejection of the compacted samples the ejection forces were recorded. The total ejection energy/enveloping area needed in order to eject the samples from the die was calculated. The following table 17 shows ejection energy, green density and the surface appearance of the samples compacted at different temperature of the die.

TABLE 17

Ejection energy, green density, surface appearance at different die temperatures

| Die temperature (° C.) | Ejection energy (J/cm$^2$) | Green density (g/cm$^3$) | Surface appearance |
|---|---|---|---|
| 25 | 38.4 | 7.64 | Perfect |
| 50 | 31.5 | 7.66 | Perfect |
| 60 | 30.6 | 7.67 | Perfect |
| 70 | 29.3 | 7.67 | Perfect |
| 80 | 27.5 | 7.69 | Perfect |

As can be seen from table 17 the ejection energy and the green density is positively influenced by increasing die temperature.

EXAMPLE 8

This example compares component properties of components manufactured according to the present invention to properties of components compacted with the aid of DWL. In both the inventive example and the comparative example a "coarse" powder according to example 3 was used. As lubricant in the inventive example 0.2% by weight of stearamide was used and the obtained powder composition was compacted at a controlled die temperature of 80° C. into ring samples having a green density of 7.6 g/cm$^3$. In the comparative example no internal lubricant was used, instead DWL was applied. Ring samples were compacted to a density of 7.6 g/cm$^3$ at ambient temperature. The ring samples outer diameter was 55 mm, inner diameter 45 mm and height 5 mm.

After compaction heat-treatment was done according to table 18. The specific electrical resistivity was measured by a 4-point method. Prior to magnetic measurements in the hysteresis graph the ring samples were wound with 100 drive and 100 sense turns. The DC properties were acquired from a loop at 10 kA/m. The core loss was measured at different frequencies at 1 T. In FIG. 1 the core loss/cycle is plotted as a function of frequency.

TABLE 18

Magnetic properties

| Sample | Heat-treatment | $B_{10\,kA/m}$ | $H_c$ [A/m] | ρ [μΩm] | Core loss @1 T, 400 Hz [W/kg] |
|---|---|---|---|---|---|
| Present invention | 530° C., 30 min air | 1.65 | 192 | 103 | 41 |
| DWL - method | none | 1.66 | 305 | 60 | 60 |
| DWL - method | 530° C., 30 min air | 1.66 | 189 | 3 | 109 |

From the table 18 and FIG. 1 it can be concluded that the present invention gives significantly lower core loss in alternating fields due to lower $H_c$ and higher resistivity compared to the DWL-method.

EXAMPLE 9

In this example it is shown that iron-powder cores with excellent magnetic properties can obtained by the present invention. The positive effect of elevated die temperature on the maximal relative permeability is also shown.

A "coarse" powder according to example 3 was mixed with various contents and types of lubricants. Both ring samples (OD=55, ID=45, h=5 mm) and bars (30×12×6 mm) were manufactured with the process conditions given in table 19.

The density was determined by measuring the mass and dimensions of the ring samples. The specific electrical resistivity was measured by a 4-point method on the ring samples. Prior to magnetic measurements in a Brockhaus hysterisis-graph the ring samples were wound with 100 drive and 100 sense turns. The DC-properties such as $\mu_{max}$ and $H_c$ were acquired from a loop at 10 kA/m while the core loss was measured at 1 T and 400 Hz. The transverse rupture strength (TRS) of the heat-treated parts was determined on the test bars by a three-point bending method.

TABLE 19

Process conditions for ring samples

| Sample | Type of lubricant | Amount Lubricant (% wt) | Compacting pressure (MPa) | Die temperature (° C.) | Heat treatment |
|---|---|---|---|---|---|
| 1 | Stearamide | 0.2 | 1100 | 25 | 300° C. 45 min, air + 520° C.*, air |
| 2 | Stearamide | 0.2 | 1100 | 80 | 300° C. 45 min, air + 520° C.*, air |
| 3 | Stearamide | 0.2 | 800 | 80 | 530° C., 30 min, air |
| 4 | Stearamide | 0.2 | 1100 | 25 | 530° C., 30 min, air |
| 5 | Stearamide | 0.2 | 1100 | 80 | 530° C., 30 min, air |
| 6 | Stearamide | 0.1 | 1100 | 85 | 530° C., 30 min, air |
| 7 | Stearamide | 0.3 | 800 | 25 | 300° C., 1 h, air + 530° C., 30 min, air |

TABLE 19-continued

| Process conditions for ring samples | | | | | |
|---|---|---|---|---|---|
| Sample | Type of lubricant | Amount Lubricant (% wt) | Compacting pressure (MPa) | Die temperature (° C.) | Heat treatment |
| 8 | Stearamide | 0.3 | 800 | 80 | 300° C., 1 h, air + 530° C., 30 min, air |
| 9 | Stearamide | 0.3 | 1100 | 25 | 300° C., 1 h, air + 530° C., 30 min, air |
| 10 | Stearamide | 0.3 | 1100 | 80 | 300° C., 1 h, air + 530° C., 30 min, air |
| 11 | Erucamide | 0.2 | 1100 | 25 | 330° C., 2 h, air + 530° C., 30 min, air |
| 12 | Erucamide | 0.2 | 1100 | 25 | 340° C., 2 h, $N_2$ + 530° C., 30 min, air |

*increasing temperature approx 4° C./min in the component up to 520° C.

TABLE 20

| Measurments of component properties | | | | | | |
|---|---|---|---|---|---|---|
| Sample | Density (g/cm$^3$) | $\mu_{max}$ | $H_c$ (A/m) | Resistivity (μOhm * m) | Core loss at 1 T 400 Hz (W/kg) | TRS (MPa) |
| 1 | 7.62 | 754 | 209 | 473 | 42 | 93 |
| 2 | 7.63 | 852 | 204 | 230 | 40 | 97 |
| 3 | 7.60 | 718 | 208 | 103 | 43 | n.a |
| 4 | 7.62 | 602 | 198 | 591 | 39 | 59 |
| 5 | 7.65 | 861 | 178 | 98 | 37 | 68 |
| 6 | 7.71 | 918 | 177 | 66 | 38 | 78 |
| 7 | 7.49 | 669 | 228 | 574 | 46 | 70 |
| 8 | 7.53 | 880 | 202 | 33 | 48 | 81 |
| 9 | 7.56 | 672 | 224 | 515 | 44 | 67 |
| 10 | 7.62 | 860 | 203 | 64 | 43 | 76 |
| 11 | 7.62 | 633 | 192 | 414 | 38 | 54 |
| 12 | 7.68 | 738 | 205 | 614 | 39 | 67 |

The invention claimed is:

1. Powder composition consisting of irregularly shaped particles of a soft magnetic material of substantially pure water-atomized iron or sponge iron, said particles being provided with an electrically insulating layer, 0.05-2% by weight of a lubricant selected from the group consisting of primary amides of saturated or unsaturated straight fatty acids having 12-24 C atoms, and optionally polyphenylene sulfide in a concentration less than 2% by weight, wherein said powder composition is capable of producing by uniaxial compaction a soft magnetic component.

2. Composition according to claim 1 wherein the fatty acid has 14-22 C atoms.

3. Composition according to claim 1, wherein the fatty acid amide is selected the group consisting of stearic acid amide, oleic acid amide, behenic acid amide, eurcic acid amide, and palmitic acid amide.

4. Composition according to claim 1 further including said polyphenylene sulfide.

5. Composition according to claim 4, wherein the polyphenylene sulfide is used in an amount of 0.1-0.5% by weight.

6. Composition according to claim 1, wherein the fatty acid amide is present in an amount of 0.05-1% by weight.

7. Composition according to claim 1, wherein the electrically insulating layer is made up of an inorganic material.

8. Composition according to claim 7, wherein the layer includes oxygen and phosphorus.

9. Composition according to claim 1, wherein less than 10% by weight of the particles have a particle size less than 45 μm.

10. Composition according to claim 9, wherein at least 20% of the particles have a particle size above 212 μm.

* * * * *